United States Patent [19]

Bruner

[11] 4,110,964

[45] Sep. 5, 1978

[54] DRAW TEXTURIZING PROCESS

[75] Inventor: Albert H. Bruner, Pensacola, Fla.

[73] Assignee: Monsanto Company, Decatur, Ala.

[21] Appl. No.: 750,744

[22] Filed: Dec. 15, 1976

Related U.S. Application Data

[63] Continuation of Ser. No. 356,241, May 1, 1973, abandoned.

[51] Int. Cl.[2] ..... D02G 1/02

[52] U.S. Cl. ..... 57/157 TS

[58] Field of Search ..... 57/34 R, 34 HS, 157 S, 57/157 TS, 157 R, 77.33

[56] References Cited

U.S. PATENT DOCUMENTS

| | | | |
|---|---|---|---|
| 2,952,116 | 9/1960 | Burleson | 57/157 TS |
| 3,270,492 | 9/1966 | Fitton et al. | 57/157 TS |
| 3,289,400 | 12/1966 | Scragg | 57/34 HS |
| 3,292,354 | 12/1966 | Chalfant et al. | 57/34 HS |
| 3,638,411 | 2/1972 | Tsugawa et al. | 57/34 HS |
| 3,708,970 | 1/1973 | MacFarlane | 57/157 TS X |
| 3,733,801 | 5/1973 | Jones | 57/157 TS |
| 3,774,383 | 11/1973 | Stemmer | 57/34 HS |
| 3,793,817 | 2/1974 | Beringer et al. | 57/34 HS |
| 3,796,036 | 3/1974 | Parker | 57/157 TS |
| 3,842,578 | 10/1974 | Schippers | 57/34 HS |

*Primary Examiner*—John Petrakes

*Attorney, Agent, or Firm*—Robert L. Broad, Jr.

[57] ABSTRACT

An improvement in the draw-texturizing process by the double heater method provides for application of pre-heat to the undrawn yarn so as to impart to the yarn sufficient tenacity to permit stringup. When stringup is completed, the undrawn yarn may be separated from the source of the pre-heat.

1 Claim, 2 Drawing Figures

DRAW TEXTURIZING PROCESS

Figure 1:
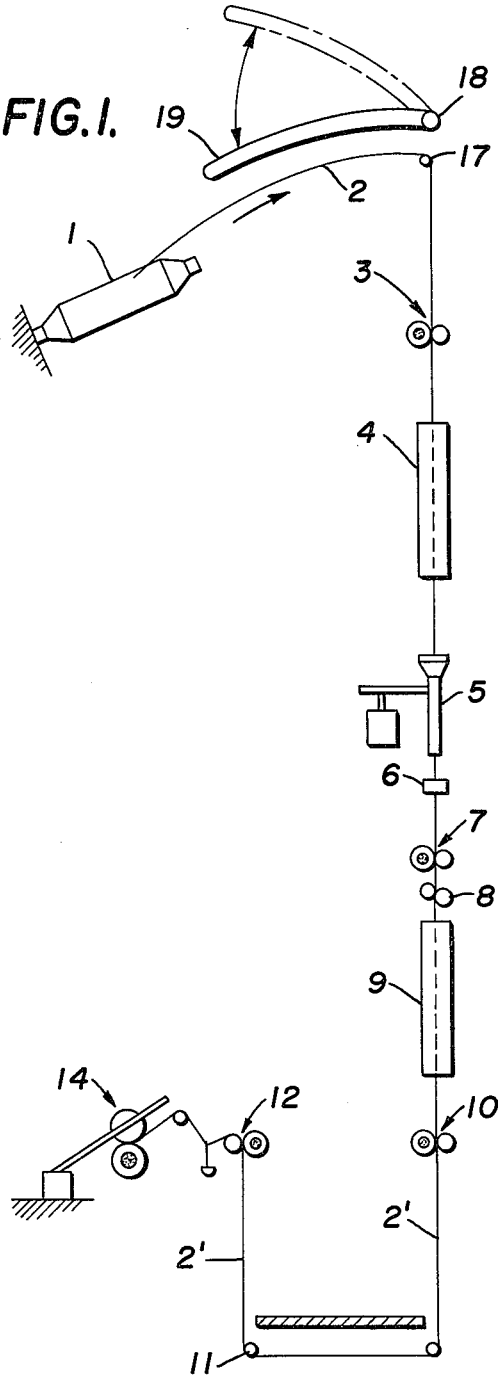

This is a continuation of application Ser. No. 356,241 filed May 1, 1973, now abandoned.

This invention relates to improvements in the process for the combination of false twist texturizing and drawing of synthetic fibers such as polyesters, polyamides and the like.

Various processes and machines are known for treating yarn to impart bulk or stretch characteristics. These include Stoddard et al U.S. Pat. Nos. 2,803,105; 2,803,108; 2,803,109; and 2,891,376; Dudzik et al U.S. Pat. No. 3,152,436, etc. These techniques involve heating the yarn after it is taken from a feed roll and before being fed through a false twist spindle where twist is applied to the heated yarn. The heating zone is correlated with the linear travel and tension of the yarn to supply sufficient heat thereto to effect proper yarn setting which reorientates the molecules of the yarn in the twisted formation to produce the crimped or coil-like configuration characteristic of stretch yarn. Control of the temperature of the heated zone is necessary to avoid having the thread scorched and/or melted. In the inevitable attempt to increase production through the use of higher speeds, control of the heat imparted to the yarn has become more and more critical.

With respect to certain types of filaments, it has been found that the so-called torque yarns produced as described above can be set or partially set by means of a second heated zone after the yarn has passed through the twist-imparting spindle. This post-heating anneals, or resets the yarn to give a limited or reduced amount of stretch to the yarn as taught in U.S. Pat. No. 3,091,912.

Also with respect to certain types of filaments, such as polyester filaments, it is now common to combine the false twist step with an orientation drawing step.

As each of these interrelated yarn treatments are superimposed one upon the other, the problem of proper control of conditions becomes more complex, particularly if yarns of low initial orientation are employed. Higher orientation can, of course, be achieved during the spin process or by partially drawing the yarn during subsequent processing; but the texturizing of more highly oriented yarn is known to result in greater torque angles in the textured product. This torque angle manifests itself, for instance, when such a yarn is knit into a tube on a circular knitting machine. For a yarn with a high torque angle the wales of the fabric will form a larger angle with the edges of the flattened tube than a yarn with a low torque angle. This higher torque angle also manifests itself in so-called increased liveliness of the yarn. This may cause processing problems in subsequent processing steps. Perhaps one of the most difficult aspects of the draw texturizing operation is the stringup because when orientation drawing is combined with the false twist texturizing, it becomes necessary to stringup a yarn lacking in sufficient durability.

It is an object of the instant invention to provide a method for imparting sufficient durability to a segment of undrawn unoriented yarn comprised of synthetic polymers, so that the said yarn can be strung up in a double heater type machine for a draw texturizing process;

It is another object of this invention to provide an improvement in draw texturizing machines whereby stringup is enabled wherever orientation drawing is to be combined with a false twist texturizing process.

Briefly, the objects of this invention are accomplished by the application of heat to the yarn before it enters the false twist texturizing zone. The yarn is pre-heated to just below the crystallization point of the undrawn fiber during or prior to the stringup operation. If the pre-heat step is continuous with the false twist texturizing processing, the temporary pre-draw application of heat may be terminated when the stringup is completed.

Figure 2:
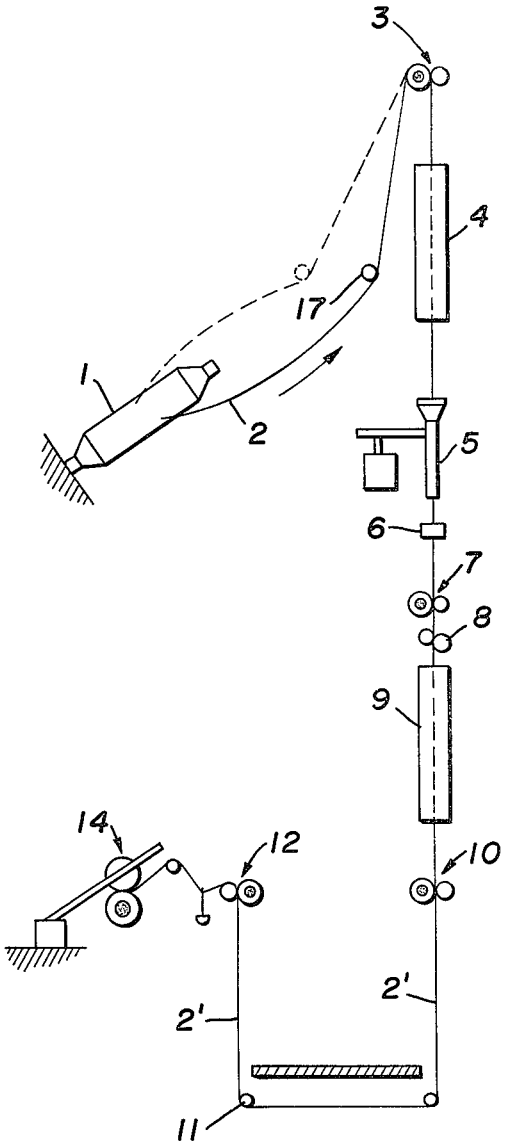

Two embodiments of the instant invention are described with reference to the drawing in which:

FIG. 1 is a schematic representation of a double heater draw texturizing process during and after stringup; and FIG. 2 is a schematic representation of another embodiment of the same draw-texturizing operation during and after stringup on a double heater machine.

Specifically referring to FIG. 1, yarn 2 is fed from supply package 1 (or directly from the spinning chimney) over entry roller 17, passing in close proximity to stringup heater 19 which is rotatably mounted on hinge 18. The yarn then passes through feed rollers 3, across first heater 4, then through false twist head 5 and past broken yarn detector 6 to draw rollers 7. Thence through guide rollers 8, past second heater 9 through delivery rollers 10, thus concluding the draw texturizing process. The yarn then passes to the takeup device 14 from third delivery rollers 12.

Referring specifically to FIG. 2, an identical process is shown; except that stringup heat is applied from the back of heater 4 by passage of the yarn to and over movable guide roller 17.

The stringup procedure in each case brings the undrawn yarn into a position with respect to contact heater 19 or the back of heater 4 so that it is warmed up to a temperature just below its crystallization point. Conventional stringup procedures are then employed, but without the previous explained difficulties involving yarn breakage. With the yarn separated for a noncritical distance from the draw and twist zone of heater 4, the yarn feeding devices are engaged and the draw ratio is locked in, with the false twist spindle being rotated at a slow speed. The speed of the false twist spindle may be increased, at the same time moving the thread line closer to the string-up heater so that the yarn is fully engaged with the heater as the false-twist spindle reaches its full speed. In the case of polyester yarn having a crystallization temperature of about 95°-100° C, a heater preheat temperature of about 100°-105° C has been found acceptable.

The preheat may also be applied as a separate (noncontinuous with the draw-texturizing) step as for example, a reheating step in conjunction with the spinning process.

It will readily be seen that such a timely application of heat to the yarn during stringup will provide sufficient durability for stringup during the stringup operation; and the provisions for removal of this heating source after stringup is a significant element of one embodiment of this invention. When stringup has been completed, application of non-orienting pre-heat to the yarn serves no useful purpose; and may be detrimental to the draw-texturizing process because the lack of tension employed with preheat may give rise to irregularities in the crystallinity; and as previously explained, the subsequent draw texturing process requires close correlation of heat and tension. Moreover, if heat were continued at this point after stringup, the molecular mobility of the yarn may be detrimentally low as the process continues. The process of this invention pre-heats only the leading end of the yarn, with the length of yarn pre-heated being a length sufficient to effect string-up of the yarn.

I claim:

1. In a draw-texturizing process for simultaneously drawing and texturizing thermoplastic synthetic yarn where the yarn is false-twisted and the false-twist is set in the yarn by means of heat, the improvement wherein the leading end of the yarn, while still undrawn, is pre-heated without substantial orientation drawing to a temperature just below its crystallization point before entering the draw-texturizing zone, said pre-heating being discontinued after a sufficient length of yarn has been pre-heated to effect string-up of the yarn.

* * * * *